US006571703B1

(12) United States Patent
Metrope

(10) Patent No.: US 6,571,703 B1
(45) Date of Patent: Jun. 3, 2003

(54) DEVICE FOR SEALING OFF AN INK-GUIDING RESERVOIR IN A PRINTING MACHINE

(75) Inventor: Jacques Metrope, Laigneville (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/688,025

(22) Filed: Oct. 13, 2000

(30) Foreign Application Priority Data

Oct. 13, 1999 (DE) ..... 199 49 346
May 31, 2000 (FR) ..... 00 07002

(51) Int. Cl.[7] ..... B41F 31/04; B41F 31/06
(52) U.S. Cl. ..... 101/350.1; 101/367; 101/363
(58) Field of Search ..... 101/363, 364, 101/365, 366, 367, 350.1

(56) References Cited

U.S. PATENT DOCUMENTS

| | | | | |
|---|---|---|---|---|
| 2,920,558 A | | 1/1960 | Hewlett | 101/364 |
| 3,339,485 A | | 9/1967 | Rytterholm | 101/363 |
| 3,831,517 A | | 8/1974 | Wagner | 101/208 |
| 4,414,900 A | | 11/1983 | Kraus et al. | 101/363 |
| 4,991,504 A | | 2/1991 | Fina | 101/208 |
| 5,182,992 A | * | 2/1993 | Rogge | 101/363 |
| 5,410,961 A | * | 5/1995 | DeNicola et al. | 101/363 |
| 5,862,756 A | | 1/1999 | Gorter | 101/364 |
| 6,109,178 A | | 8/2000 | Furukawa | 101/350.6 |

FOREIGN PATENT DOCUMENTS

| | | |
|---|---|---|
| DE | 1 224 327 | 9/1966 |
| DE | 2 411 771 | 9/1974 |
| DE | 30 43 234 A1 | 7/1982 |
| DE | 34 08 183 C1 | 3/1985 |
| DE | 230 483 A3 | 12/1985 |
| DE | 40 01 733 A1 | 7/1991 |
| DE | 94 05 883.0 | 7/1994 |
| DE | 195 36 765 A1 | 4/1997 |
| DE | 196 31 30 A1 | 2/1998 |
| EP | 0 374 092 A2 | 6/1990 |
| EP | 0 812 687 A2 | 12/1997 |
| FR | 2 734 512 A1 | 11/1996 |
| GB | 2 145 973 A | 4/1985 |

* cited by examiner

*Primary Examiner*—Daniel J. Colilla
(74) *Attorney, Agent, or Firm*—Laurence A. Greenberg; Werner H. Stemer; Ralph E. Locher

(57) ABSTRACT

A device for holding an ink supply in an ink-feeding device in an inking unit of a printing machine, the ink supply being received in a reservoir defined by lateral surfaces having contact surfaces for sealing off the ink supply with respect to a rotating surface, comprising a resilient element for sealing off a gap, the resilient element being received in respective side parts of an ink-feeding device, and setting elements for applying a setting force to the side parts; and an ink duct; an inking unit; and a printing unit, respectively, including the device.

16 Claims, 3 Drawing Sheets

DEVICE FOR SEALING OFF AN INK-GUIDING RESERVOIR IN A PRINTING MACHINE

BACKGROUND OF THE INVENTION

FIELD OF THE INVENTION

The invention relates to a device for sealing off an ink-guiding reservoir, such as an ink duct or fountain, in a printing machine, whether a web or sheet material-processing printing machine.

The published European Patent Document EP 0 812 687 A2 discloses an ink duct or fountain for printing machines and a method of operating a printing machine. The solution described therein is concerned with sealing off the side surfaces of an ink duct which is provided on an ink-duct roller of an inking unit operating in accordance with the anilox principle, for example. Arranged on the ink duct is an ink-duct roller, against which an inking chamber, which is defined by two doctor blades, is set. The two doctor blades are a metering doctor blade and a doctor blade for removing contaminates, both being accommodated on end surfaces bounding the inking chamber. The end surfaces which bound the inking chamber and accommodate the doctor blade and the contaminant-removing doctor blade are supported on the ink-duct roller. In the aforementioned disclosure of the European Patent Document EP 0 812 687 A2, a first pressure is exerted on the ink-duct roller by the end surfaces, and a second, higher pressure is exerted on the metering doctor blade and the doctor blade for removing the contaminants. In addition, recesses are provided in the end surfaces and are closed by a circumferential closed web, in order to produce a higher local stiffness at the doctor-blade clamping points than at the roller surface.

The published German Patent Document DE 34 08 183 C1 has disclosed an ink duct or fountain for printing machines, having a lower part forming an ink duct blade. This ink duct blade is adjustable with respect to the ink-duct roller, the ink supply being located between the lower part and the ink-duct roller and being defined at both ends by ink-duct jaws which seal off the ink duct with respect to the circumferential surface of the ink-duct roller by a sealing surface. The ink that emerges as a result of leakage losses is fed back to the ink supply again, by which contamination of the inking unit is avoided. For this purpose, on the ink-duct jaws, more specifically on the respective sealing surfaces thereof facing towards the ink-duct roller, a contact surface is formed, which covers part of the width of the ink-duck jaw and extends obliquely with respect to the latter, so that the lower end of the contact surface faces toward the inner side of the ink duct. In addition to an obliquely extending contact surface, this surface may also be formed so as to extend spirally or helically.

The sealing action of the contact surface disclosed by the published German Patent Document DE 34 08 183 C1 depends to a great extent upon the manufacturing precision of the ink-duct jaws, and also upon the positioning accuracy thereof relative to the ink-duct roller. A deviation in the curvature of the ink-duct jaw and the ink-duct roller remains, because of manufacturing tolerances which inevitably occur. The resilient elastomeric material used for the ink-duct jaws is subject to moisture and temperature fluctuations, to which the printing machine is subjected in relation to a wide range of production conditions. The dimensional stability of a synthetic material is not ensured under these environmental influences. As a result, in spite of an initially functioning sealing action, leaks at the ink duct can occur over the course of operation of the printing machine.

Finally, the published French Patent 2 734 512 has disclosed a further ink duct for a printing machine, wherein the ink-duct jaws are likewise set by an adjusting element against the ink-duct roller surface in order to achieve a sealing action. With the aforementioned adjusting device, inaccuracies which have been determined and which result during the manufacture of the ink-duct jaws are intended to be compensated for. The contact surface of the ink-duct jaws on the ink-duct roller should run cylindrically in order to ensure continuous contact around the surface of the ink-duct roller. By using the improvement disclosed by the French Patent 2 734 512, the cylindricity of the contact surfaces cannot be maintained, because with the proposed construction only part of the surface curvature of the contact surface of the ink-duct jaw is deformed. It is therefore not possible for an optimum sealing action to be achieved by using the proposed improvement disclosed by the French Patent 2 734 512.

SUMMARY OF THE INVENTION

It is accordingly an object of the invention, to provide, based upon the outlined prior art, a device for sealing off an ink-guiding reservoir in a printing machine by which sealing is ensured during all operating phases of the printing machine.

With the foregoing and other objects in view, there is provided, in accordance with one aspect of the invention, a device for holding an ink supply in an ink-feeding device in an inking unit of a printing machine, the ink supply being held in a reservoir defined by lateral surfaces having contact surfaces for sealing off the ink supply with respect to a rotating surface, comprising a resilient element for sealing off a gap, the resilient element being received in respective side parts of an ink-feeding device, and setting elements for applying a setting force to the side parts.

In accordance with another feature of the invention, the contact surfaces are curved, and the setting force sets the side parts with the curved contact surface thereof against a surface part of an ink-supply conveying surface.

In accordance with a further feature of the invention, the ink-feeding device includes an ink-duct blade, and the side parts have a planar surface by which the side parts are set against the ink-duct blade by the setting force.

In accordance with an added feature of the invention, the side parts are formed with respective recesses for accommodating therein the resilient sealing elements for transmitting the setting force.

In accordance with an additional feature of the invention, the resilient elements for sealing off the gap are enclosed on many sides by the recesses.

In accordance with yet another feature of the invention, the resilient elements contact the rotating surface for conveying the ink supply along contact lines extending perpendicularly to the rotating surface.

In accordance with yet a further feature of the invention, the contact lines on the resilient element define a concave curvature.

In accordance with yet an added feature of the invention, the setting elements for producing the setting force are accommodated in the side parts.

In accordance with yet an additional feature of the invention, the setting elements for producing the setting force are supported on stops provided on a component of the ink-feeding device.

In accordance with still another feature of the invention, the ink-feeding device includes an ink-duct blade, the rotating surface is on a roller for conveying the ink supply, and the side parts are movable relative to the rotating surface of the roller for conveying the ink supply, and relative to the ink-duct blade.

In accordance with still a further feature of the invention, the setting elements for producing the setting force are actable on an upper side of the side parts.

In accordance with still an added feature of the invention, the ink-feeding device includes an ink-duct blade, and a flat surface of the side parts accommodates a sealing element which, due to the setting elements, seals off a gap with respect to the ink-duct blade.

In accordance with still an additional feature of the invention, a side of the resilient element facing towards the rotating surface has a friction-reducing coating applied thereto.

In accordance with another feature of the invention, the friction-reducing coating covers part of the width of the resilient element.

In accordance with a second aspect of the invention, there is provided an ink duct in an inking unit of a printing machine, for holding an ink supply in a reservoir defined by lateral surfaces having contact surfaces for sealing off the ink supply with respect to a rotating surface, comprising a resilient element for sealing off a gap, the resilient element being received in respective side parts of an ink-feeding device, and setting elements for applying a setting force to the side parts.

In accordance with a third aspect of the invention, there is provided an inking unit in a printing machine having a device for holding an ink supply in a reservoir defined by lateral surfaces having contact surfaces for sealing off the ink supply with respect to a rotating surface, comprising a resilient element for sealing off a gap, the resilient element being received in respective side parts of an ink-feeding device, and setting elements for applying a setting force to the side parts.

In accordance with a fourth and concomitant aspect of the invention, there is provided a printing unit in a printing machine, having a device for holding an ink supply in a reservoir defined by lateral surfaces having contact surfaces for sealing off the ink supply with respect to a rotating surface, comprising a resilient element for sealing off a gap, the resilient element being received in respective side parts of an ink-feeding device, and setting elements for applying a setting force to the side parts.

Thus, acting upon the side parts with a setting force which acts upon the rotating surface conveying the ink supply ensures that the gap between this rotating surface and the contact surface of the side part remains closed. The ink supply cannot escape sideways, because there is no opening which permits escape. The setting elements, which are supported on or braced against a stop, apply defined setting forces which are matched to the material sealing off the gap. In order to increase the stability of the resilient element, the latter can very advantageously be accommodated in a circumferential groove on the side part and bottom part of the ink-feeding device.

In a further configuration of the concept upon which the invention is based, the setting force acts upon the entire contact surface of the side parts, the curved contact surfaces of the side parts, which have a radius of curvature corresponding to that of the rotating surface that conveys the ink supply, are set against this rotating surface in such a way that the contact surface as a whole is set against the rotating surface, and no tilting or rotation of the side part as a whole takes place. This ensures the uniform area pressure on the contact point between the rotating surface and the resilient sealing element, so that premature wear of the resilient sealing element is countered. The setting force that acts upon the side part acts thereon not only in the direction of the rotating surface but also in the direction of the bottom surface of the ink duct. It is therefore possible for the side part, which is movable relative to the rotating surface that conveys the ink supply and relative to the bottom surface, always to be acted upon with setting forces in a sufficient manner that the sealing action is ensured at all times.

As a safeguard against crushing the resilient elements in the sealing gap, the resilient elements are accommodated in recesses, such as grooves extending circumferentially in the side part. The resilient elements are disposed in recesses formed with a rectangular, square, round or oval cross section, for example, so that they project beyond or above the side edge of the recess, in order to effect the sealing action with the surface of the ink-duct roller. In order to reduce the friction generated during the relative movement that occurs between the contact surface and the moving surface that conveys the ink supply, contact lines can be impressed or embossed on resilient elements arranged perpendicularly to the ink-duct roller, and ensure a linear contact, which reduces the friction considerably, between the rotating surface and the contact surface. The tightness of the seal against leakage may then be produced, for example, by two or even more contact lines, which are separated from one another by concave curvatures, being produced on the resilient element, it being possible for this to represent a cascade-like barrier to the ink supply accommodated in the interior of the ink duct, and thus to permit effective sealing of the ink supply against penetration to the outside.

The side parts that are movable relative to the surface that conveys the ink supply and relative to the bottom part of the feeding device, accommodate within themselves setting elements which, for example, can be provided in a drilled or bored hole. In a manner which advantageously assists the sealing action, the setting elements are supported on or braced against stops which, in turn, can be inserted into the bottom part of the ink-feeding device.

In addition to setting of the contact surface armed with resilient elements directly onto the surface of the ink duct, the resilient elements may also be provided with a friction-reducing coating; the friction-reducing coating can cover the resilient elements wholly or partially; both constructions are conceivable. One of the contact lines, for example, can be provided with the friction-reducing coating, while the remaining contact line can be in direct contact with the surface that conveys the ink supply. The sealing action of the pair of contact lines on the resilient element is not reduced, while the friction may be reduced considerably.

A device for holding the ink supply according to the invention of the instant application can be used in the ink duct of rotary printing machines, for example, whether for printing machines processing sheets or webs, for offset, gravure or flexographic printing applications. The ink duct can be associated with an inking unit of a printing unit of a rotary printing machine which is suitable for jobbing or commercial printing, newspaper printing or even for printing securities. A side part according to this invention can be accommodated, in particular, as a partial surface in the ink duct, in order to permit the application of a number of inks from one ink duct, which is quite usual, in particular in rotary newspaper presses.

Other features which are considered as characteristic for the invention are set forth in the appended claims.

Although the invention is illustrated and described herein as embodied in a device for sealing off an ink-guiding reservoir in printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
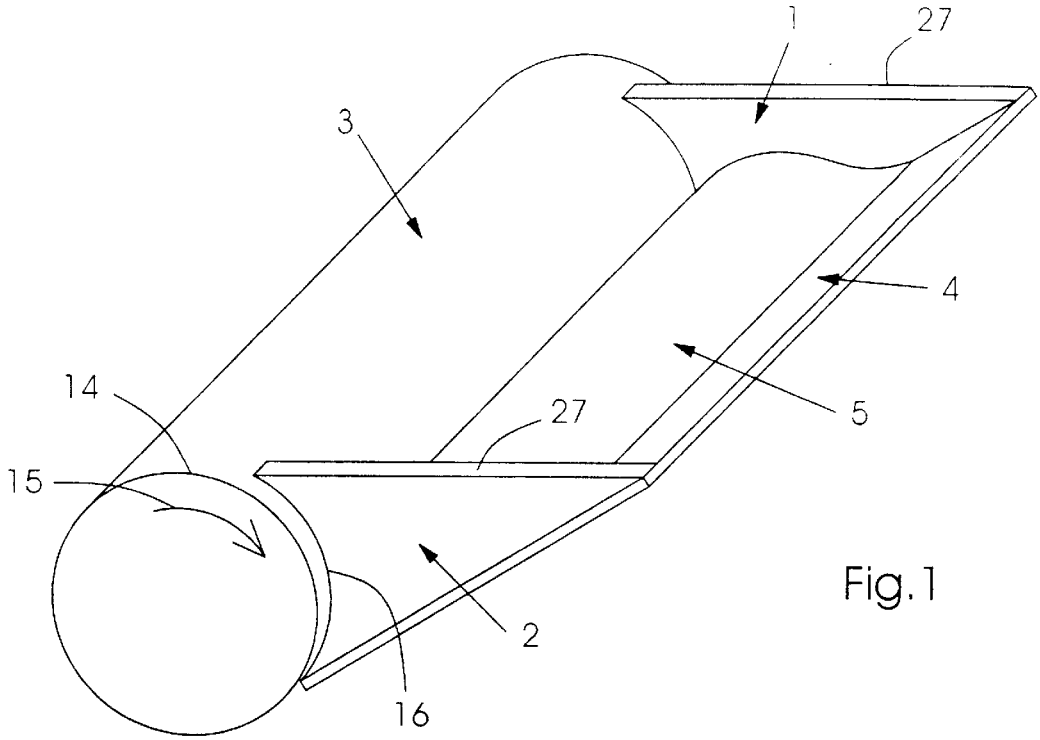
FIG. 1 is a diagrammatic front, side and top perspective view of an ink duct.

Referring now to the drawings and, first, particularly to FIG. 1 thereof, there is shown therein a plan view of an ink duct.

An ink feeding device or reservoir commonly used in rotary printing machines is shown including an ink-duct roller 3, an ink-duct blade or knife 4, which functions as the bottom part of the ink duct, and side parts 1 and 2 which are mounted laterally in relation to the ink-duct roller 3. Within these four components of the ink-feeding device of a printing machine, an ink supply 5 is held and is fed in a metered manner to an inking unit generally including a number of rollers effecting ink-film splitting. By the ink-duct roller 3, which moves in the direction of rotation 15, and the ink-duct blade 4 set against the surface 14 thereof, the metering of the ink supply 5 is performed by setting the ink-duct blade 4, which forms the bottom of the ink duct and which can be subdivided zonally into individual ink-knife tongues, or act even as a whole, against the surface 14 of the ink-duct roller 3 or away from the latter.

The side parts 1 and 2 which seal off the ink supply 5 against undesired lateral emergence from the ink-feeding devices have contact surfaces 16, formed with a respective contour that is matched to the curvature of the surface 14 of the ink-duct roller 3, in order in this manner to produce the tightest possible contact between the side parts 1 and 2, on the one hand, and the surface 14 of the ink-duct roller 3, on the other hand. The side parts 1 and 2 of the ink-feeding device have an upper edge 27 extending horizontally, which limits the maximum level in the ink duct.

Figure 2:
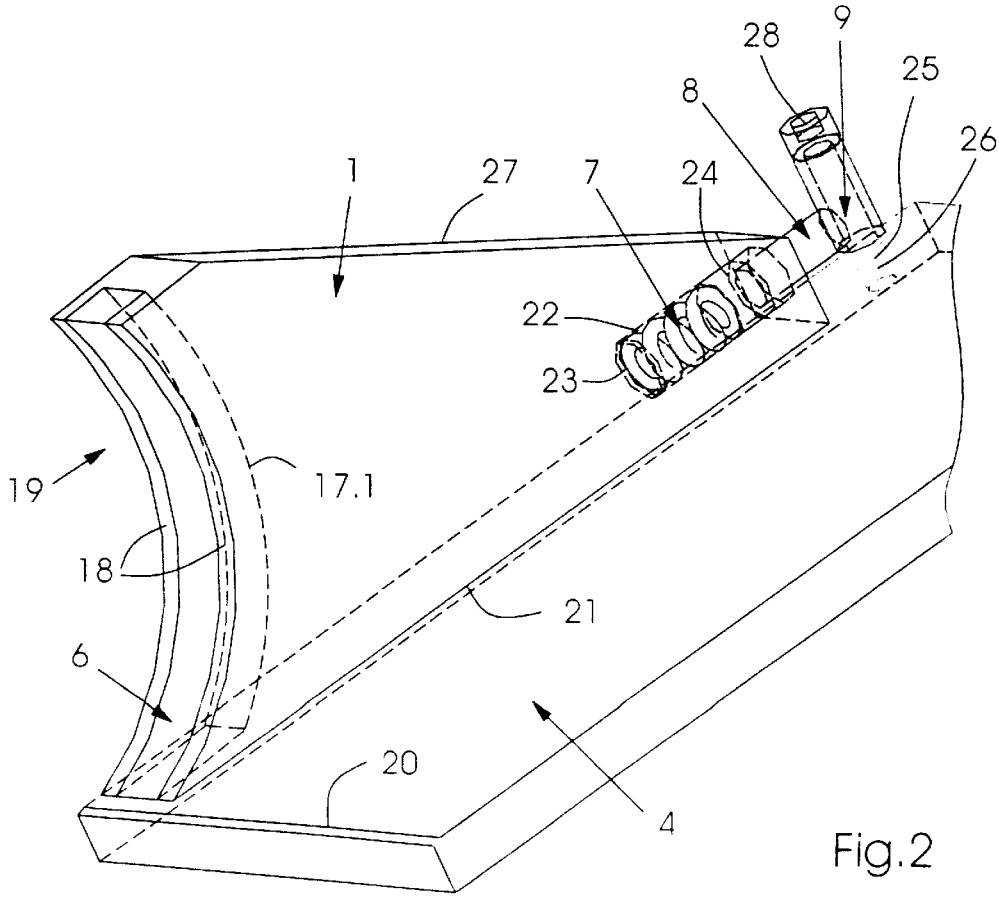
FIG. 2 is an enlarged fragmentary view of a side part of the ink duct according to the invention, having a recess formed therein for a resilient element on a front side thereof.

FIG. 2 is a view of a side part according to the invention, which is formed with a recess for a resilient element on a front side thereof.

The side part 1 is mounted on the ink-duct blade 4 so as to be relatively displaceable therewith, the ink-duct blade 4 having a metering edge 20 with a slight chamfer. With a lower edge 21 thereof, the ink-duct blade 4 seals off the ink supply against the ink-duct roller 3, and curved contact surfaces 16 are formed on the front side of the side parts 1 and 2. The recesses 17 (note FIG. 4, for example) in the contact surfaces 16 are matched to the curvature of the surface 14 of the ink-duct roller 3. Received in the recesses 17, which can have a square, rectangular or even a round cross section, is a resilient element 6. The configuration of the recesses 17 is of such dimensions that the resilient element 6 received therein projects just beyond the side edges 18 of the recess 17 and projects just out of the recess 17 surrounding it. The course of the curvature of the resilient element 6 is of such dimensions that, along the course of the curvature 19, there is clear assurance that the resilient element 6 will protrude from the recess 17. When the contact surface 16 of the side parts 1 and 2 is set against the moving surface 14 of the ink-duct roller 3, uniform contact between the resilient element 6 and the surface 14 can be ensured in this way.

Provided in the rear region of the side parts 1 and 2 are the constructional elements which produce the setting force. Each of the side parts 1 or 2 has a respective drilled bore 22 formed at one end 23 thereof, with a supporting surface. Received in the borehole 22 is a spring element 7, formed, for example, as a helical or spiral spring. Provided above the spiral spring 7 is a cylindrical body 24 which has a pin-like extension 8. The pin-like extension 8 is supported on a stop 9, which is screwed to the ink-duct blade 4 forming the bottom surface of the ink duct. For this purpose, the ink-duct blade 4 is formed, in a side region thereof, with threaded boreholes 26, into which the stops 9 are screwed by the thread 25 thereof. The cylindrical surfaces formed as stops 9 may be configured, in this case, as union or coupling cylinders which are merely placed on a screw 25 before they are tightened with an annular tool attachment 28 that covers the cylinder.

By this setting element which is arranged parallel to the incline or slope of the bottom part or ink-duct blade 4, the side parts 1 and 2 are displaceable relative to the ink-duct blade 4, so that uniform setting of the resilient element 6 according to the course of the curvature 19 against the surface 14 of the roller 3 that conveys the ink supply 5 is assured.

Depending upon the viscosity of the ink to be processed, the setting or adjustment force to be produced can be preset by the length of the cylindrical body 24 in the borehole 22, so that an optimum sealing action at the curved contact surface 16 is achievable. Depending upon the configuration of the ink duct, the contact between the lower edge 21 and the bottom part 4, which is to be of planar form, can be improved via spring elements set against the upper edge 27 of the side parts 1 and 2.

Figure 3:
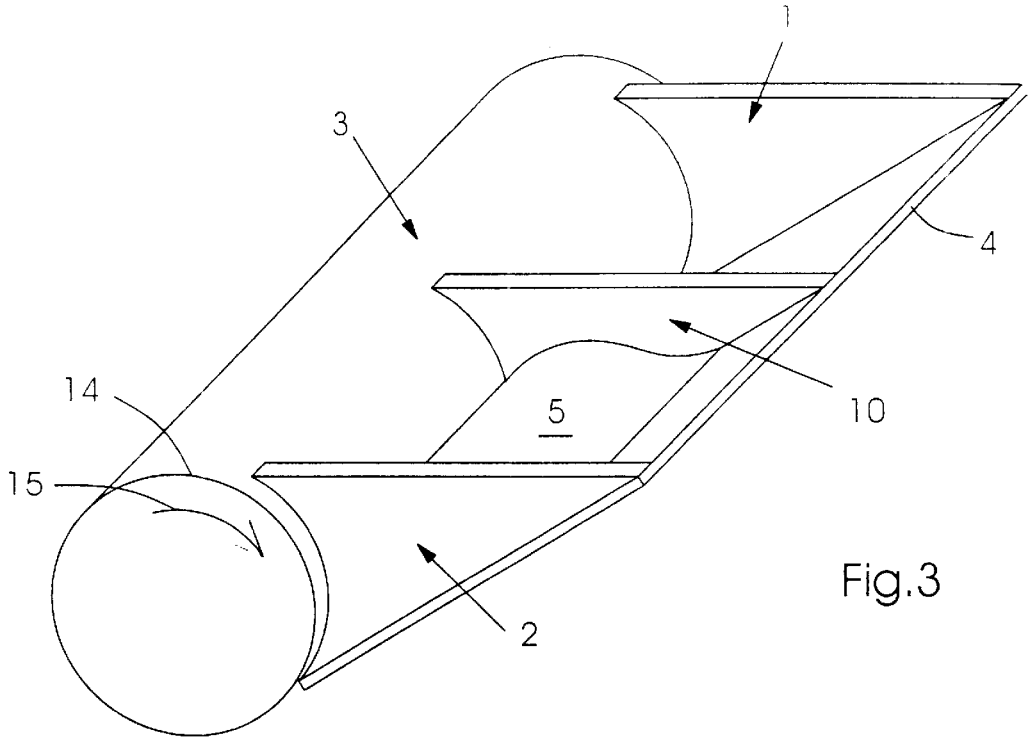
FIG. 3 is a view like that of FIG. 1 of another embodiment of the ink duct divided by a partition in order to process two ink supplies in one ink duct.

FIG. 3 shows an ink duct divided by a partition or side part 10, in order to convey a limited supply of ink only in a specific inking zone.

The different embodiment according to FIG. 3 is particularly advantageous for newspaper rotary-press applications, wherein areas are inked with different inks over the width of an inking or printing unit. In the case of newspaper rotary presses, for example, the ink zones can be supplied by separate ink supplies. The ink supplies can be held in a unitary or regular ink duct, as illustrated in FIG. 3, it being possible for the ink duct to be subdivided, over the width thereof, by a central or several partial surfaces or partitions, into various inking chambers, wherein, respectively, different ink supplies are held. It is therefore possible for different inking regions over the width of the ink duct to be inked with different ink supplies, respectively, by which subject-dependent inking of the newspaper can be performed by the subdivision of the ink duct.

Figure 4:
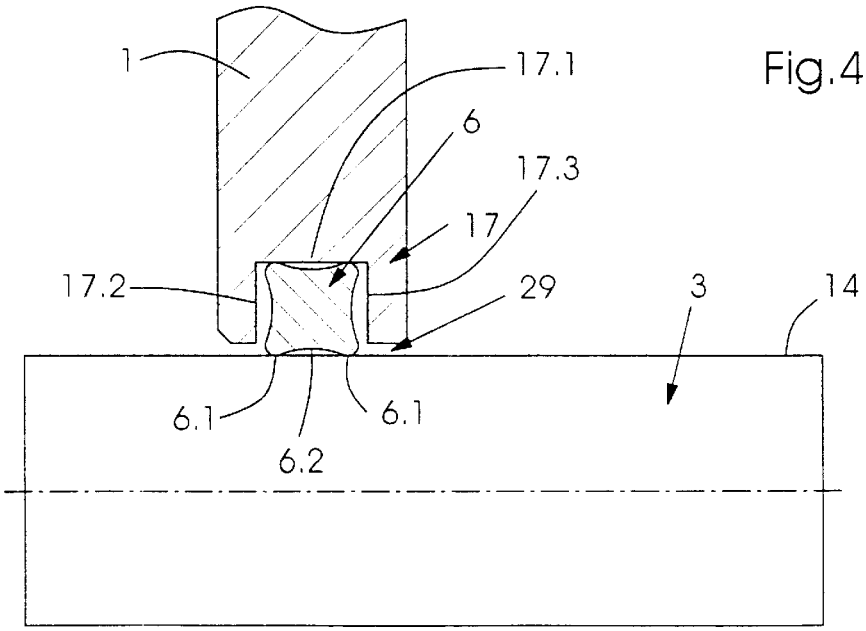
FIG. 4 is an enlarged fragmentary view, partly in section, of either FIG. 1 or FIG. 3 showing a bearing and a contact region of a resilient element on a moving surface, in accordance with the invention.

FIG. 4 shows, on an enlarged scale, the contact surface of a side part or partition with the surface of the ink-duct roller that conveys the ink supply.

In the side part 1, which can be formed of metal, plastic material from an elastomer or a synthetic material produced in any other way, a recess 17 being formed on a side thereof facing towards the roller surface 14. In the exemplary embodiment shown according to FIG. 4, the recess 17 has an approximately square cross section. The resilient element 6 received in the recess 17 in accordance with the course of the curvature 19 thereof (note FIG. 2) has a somewhat square cross section, the outer edges thereof, respectively, being configured with contact lines 6.1 formed with a concave curvature 6.2 therebetween. With two of the outer edges 6.1 thereof, the resilient element 6 is in contact with the surface 14, the contact surface being a linear contact region extending perpendicularly to the axis of rotation of the ink-duct roller 13. Due to the linear contact of the edges 6.1 of the resilient element 6, friction between the elastic element 6 and the ink-duct surface can be reduced considerably when compared with a full-area contact. In the exemplary embodiment shown, full-area contact is prevented by providing the concave curvature 6.2 between the two contact edges 6.1. The area of the resilient element 6 that protrudes from the recess defined by the edges 17.1, 17.2 and 17.3 seals off the sealing gap 29 between the inking-roller surface 14 and the side part 1. Sealing is achieved via the aforementioned contact lines arranged perpendicularly to the direction of rotation of the ink-duct roller surface 14, which effectively close the gap 29. In order to reduce the friction between the contact edges 6.1 of the resilient element 6, the contact edges 6.1 can also be provided with a friction-reducing coating. In addition, only one of the two contact edges 6.1 illustrated in accordance with the embodiment of FIG. 4 can be provided with a friction-reducing coating. Once the contact edges 6.1 on one side of the contact element 6 formed with a square cross section have become worn or used up, after the side part 1 has been dismantled, the contact element 6 is merely rotated through 90° in the respective recess 17 thereof, so that two yet unused contact edges 6.1, respectively, can again make a connection with the surface of the ink-duct roller. Sealing off the sealing gap 29 by two contact edges 6.1 extending in parallel has the effect of additional safety, so that in the event of damage to the inner of the contact edges 6.1, the remaining, outer contact edge 6.1 prevents the ink supply 5 held in the ink duct from emerging through the sealing gap 29 between the contact surface 16 and the ink-duct roller surface 14.

Figure 5:
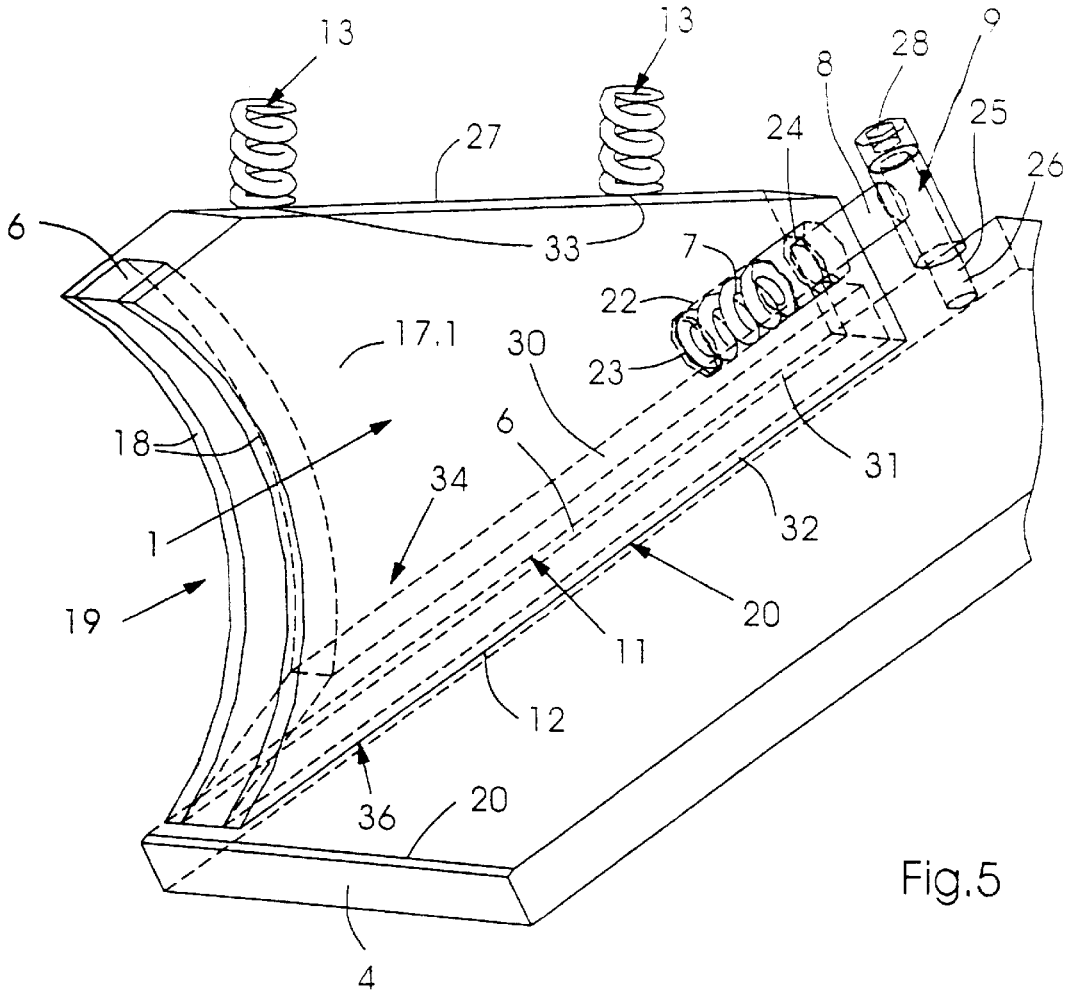
FIG. 5 is a view like that of FIG. 2 showing a side part of the ink duct with a circumferential recess that is assigned to a curved surface and a bottom part, and having a spring-loaded upper side and a rearward holder for setting elements.

FIG. 5 illustrates a side part 1 of an ink-feeding device having a circumferential recess 17 which is assigned to the contact surface 16 and the bottom part 4, the side part 1, at an upper side thereof, being acted upon by a setting or adjusting force and being supported with the rear part thereof on a stop 9.

The course of the curvature 19 can be seen in the contact region 16 of the side part 1, both the side edges 18 bounding one recess 17, and the resilient element 6, which emerges from the recess 17, following this curvature 19. The contact edges 6.1 and 6.2 (note FIG. 4) with which the gap 29 between the front side of the side part 1 and the surface 14 of the ink-duct roller 3 that conveys the ink supply 5 is sealed off, are indicated at the resilient element 6. The upper edge 27 of the side part 1, 2 is acted upon by pressure elements. In the embodiment according to FIG. 5, the pressure elements can be springs, for example, helical or spiral springs, but spring piles or sets can also be provided.

The recess 17 mentioned herein before in connection with FIG. 2, and specifically identified in FIG. 4, finds a continuation thereof in a further recess 30 formed in the lower contact surface 12. The recess 30 in the lower planar surface 12 of the side part 1 is defined by two side edges 31 and 32. Protruding beyond the side edges 31 and 32 of the lower recess 30, a resilient element 11 which has been formed in a manner similar to that of the resilient element 6 according to FIG. 4, is provided. The resilient element 11, received in the recess 30, seals off the sealing gap 36 between the planar surface 12 of the side part 1 and the upper side of the ink-duct blade 4, serving as the bottom part of the ink feeding device, against the undesired emergence of ink at the side surfaces. The two recesses 17 and 30, which can be formed as grooves with a rectangular or square cross section, abut in the transition area 34. In the embodiment of the side part 1 according to FIG. 5, a borehole 22 is likewise provided in the rear area of the side part 1, and the end 23 thereof serves as a supporting surface for a spring element 7. The spring element 7 can be configured, for example, as a helical or spiral spring, above which a cylindrical body 24 provided with a pin extension 8 is arranged.

The pin extension 8, appropriately rounded, is supported on the outer surface of a stop 9. The stop 9 can be screwed into a drilled borehole 26 in the bottom part 4 of the ink-feeding device via a thread 25. The cylinder can be a simple annular union cylinder, which is simply screwed onto the pin screwed to the bottom part by a tool attachment 28 in the shape of an internal hexagonal nut. As a result of this arrangement, the side part 1 that is displaceable relative to the ink-duct roller surface 14 and relative to the bottom part 4 is both under a constant setting force against the ink-duct surface and also under a constant setting force against the bottom part of the ink-feeding device 4. The setting force acting upon the bottom part 4 can be made uniform by a number of sprung elements 13 provided along the upper edge 27. Depending upon the selection of the configuration of the cylinders 24, which can be inserted into the drilled or bored hole 22 in the side parts, the level of the setting force against the roller surface 14 can be preset. One possible configuration would, moreover, be to dimension the cross sections of the resilient elements 6 and 11 in the recesses 17 and 30, respectively, in such a way that they engage in opposite depressions formed in the surface of the ink-duct roller 14 or in the bottom part 4 of the ink-feeding device. In addition to being held in the side part formlockingly or positively so as to prevent any crushing of the sealing elements 6, a formlocking sealing action by the resilient elements with the contact surfaces opposite thereto could also be achieved. In this regard, it is noted that a formlocking connection is one which connects two elements together due to the shape of the elements themselves, as opposed to a forcelocking connection, which locks the elements together by force external to the elements.

I claim:

1. A device for holding an ink supply in an inking unit of a printing machine, comprising:

an ink-duct roller with a rotating surface;

an ink-feeding device including an ink-duct blade and side parts, said side parts having contact surfaces in contact with said rotating surface, a planar surface in contact with said ink-duct blade and an upper edge;

said side parts with said contact surfaces defining a reservoir holding the ink supply for sealing off the ink supply with respect to said rotating surface;

a resilient sealing element for sealing off a gap formed between said contact surfaces and said rotating surface, said resilient sealing element being received in said side parts of said ink-feeding device; and setting elements for applying a setting force to said side parts causing said resilient sealing element to contact said rotating surface for conveying the ink supply along contact lines extending in a surface perpendicularly to said rotating surface.

2. The ink-supply holding device according to claim 1, wherein said contact surfaces are curved, said rotating surface is an ink-supply conveying surface, and said setting force sets said side parts with said curved contact surface thereof against a surface part of said ink-supply conveying surface.

3. The ink-supply holding device according to claim 1, wherein said side parts are set against said ink-duct blade by said setting force.

4. The ink-supply holding device according to claim 1, wherein said side parts are formed with respective recesses for accommodating therein said resilient sealing element for transmitting said setting force.

5. The ink-supply holding device according to claim 4, wherein said resilient sealing element is substantially enclosed by said recesses.

6. The ink-supply holding device according to claim 1, wherein said contact lines on said resilient sealing element define a concave curvature.

7. The ink-supply holding device according to claim 1, wherein said setting elements for producing said setting force are accommodated in said side parts.

8. The ink-supply holding device according to claim 1, wherein said setting elements for producing said setting force are supported on stops provided on a component of said ink-feeding device.

9. The ink-supply holding device according to claim 1, wherein said side part are movable relative to said rotating surface of said ink-duct roller and relative to said ink-duct blade.

10. The ink-supply holding device according to claim 1, wherein said setting elements for producing said setting force are actable on said upper edge of said sides parts.

11. The ink-supply holding device according to claim 1, wherein a side of said resilient sealing element facing towards said rotating surface has a friction-reducing coating applied thereto.

12. The ink-supply holding device according to claim 11, wherein said friction-reducing coating covers part of the width of said resilient element.

13. The ink-supply holding device according to claim 1, wherein said planar surface of said side parts accommodates said sealing element sealing off a gap with respect to said ink-duct blade by said setting elements.

14. An ink duct in an inking unit of a printing machine, for holding an ink supply, comprising:

an ink-duct roller with a rotating surface;

an ink-feeding device including an ink-duct blade and side parts, said side parts having contact surfaces in contact with said rotating surface, a planar surface in contact with said ink-duct blade and an upper edge;

said side parts with said contact surfaces defining a reservoir holding the ink supply for sealing off the ink supply with respect to said rotating surface;

a resilient sealing element for sealing off a gap formed between said contact surfaces and said rotating surface, said resilient sealing element being received in said side parts of said ink-feeding device; and setting elements for applying a setting force to said side parts causing said resilient sealing element to contact said rotating surface for conveying the ink supply along contact lines extending in a surface perpendicularly to said rotating surface.

15. An inking unit in a printing machine having a device for holding an ink supply, the device comprising:

an ink-duct roller with a rotating surface;

an ink-feeding device including an ink-duct blade and side parts, said side parts having contact surfaces in contact with said rotating surface, a planar surface in contact with said ink-duct blade and an upper edge;

said side parts with said contact surfaces defining a reservoir holding the ink supply for sealing off the ink supply with respect to said rotating surface;

a resilient sealing element for sealing off a gap formed between said contact surfaces and said rotating surface, said resilient sealing element being received in said side parts of said ink-feeding device; and setting elements for applying a setting force to said side parts causing said resilient sealing element to contact said rotating surface for conveying the ink supply along contact lines extending in a surface perpendicularly to said rotating surface.

16. A printing unit in a printing machine, having a device for holding an ink supply, the device comprising:

an ink-duct roller with a rotating surface;

an ink-feeding device including an ink-duct blade and side parts, said side parts having contact surfaces in contact with said rotating surface, a planar surface in contact with said ink-duct blade and an upper edge;

said side parts with said contact surfaces defining a reservoir holding the ink supply for sealing off the ink supply with respect to said rotating surface;

a resilient sealing element for sealing off a gap formed between said contact surfaces and said rotating surface, said resilient sealing element being received in said side parts of said ink-feeding device; and setting elements for applying a setting force to said side parts causing said resilient sealing element to contact said rotating surface for conveying the ink supply along contact lines extending in a surface perpendicularly to said rotating surface.

* * * * *